US009584932B2

(12) United States Patent
Zurbruegg et al.

(10) Patent No.: US 9,584,932 B2
(45) Date of Patent: Feb. 28, 2017

(54) METHOD FOR OPERATING A HEARING DEVICE AND A HEARING DEVICE

(71) Applicant: Sonova AG, Stafa (CH)

(72) Inventors: Thomas Zurbruegg, Zurich (CH); Andre Niederberger, Mannedorf (CH)

(73) Assignee: SONOVA AG, Stafa (CH)

( * ) Notice: Subject to any disclaimer, the term of this patent is extended or adjusted under 35 U.S.C. 154(b) by 0 days.

(21) Appl. No.: 14/894,007

(22) PCT Filed: Jun. 3, 2013

(86) PCT No.: PCT/EP2013/061404

§ 371 (c)(1),
(2) Date: Nov. 25, 2015

(87) PCT Pub. No.: WO2014/194932

PCT Pub. Date: Dec. 11, 2014

(65) Prior Publication Data

US 2016/0105751 A1 Apr. 14, 2016

(51) Int. Cl.
*H04R 25/00* (2006.01)

(52) U.S. Cl.
CPC ..... *H04R 25/505* (2013.01); *H04R 25/407* (2013.01); *H04R 25/30* (2013.01);
(Continued)

(58) Field of Classification Search
CPC .. H04R 25/305; H04R 25/405; H04R 25/407; H04R 25/453; H04R 25/505;
(Continued)

(56) References Cited

U.S. PATENT DOCUMENTS 6,041,129 A 3/2000 Adelman
7,853,031 B2 12/2010 Hamacher
(Continued)

FOREIGN PATENT DOCUMENTS

EP 1 956 589 B1 8/2008
WO 03/073790 A1 9/2003
(Continued)

OTHER PUBLICATIONS

International Search Report for PCT/EP2013/061404 dated Mar. 28, 2014.
Written Opinion for PCT/EP2013/061404 dated Mar. 28, 2014.

*Primary Examiner* — Joseph J Nguyen
*Assistant Examiner* — Joshua Kaufman
(74) *Attorney, Agent, or Firm* — Pearne & Gordon LLP

(57) ABSTRACT

A method for operating a hearing device including an ambient microphone, a signal processing unit, a receiver and an ear canal microphone. The method includes steps of filtering the audio signal processed by the signal processing unit with a filter having a transfer function including a transfer function from an output of the receiver to an input of the ear canal microphone when the hearing device is turned on and being worn in an ear canal of the user, computing a difference between the audio signal picked up by the ear canal microphone and the filtered signal, and detecting a presence of own-voice of the user based on the difference. Furthermore, a hearing device including an own-voice detection unit is provided, which is adapted to perform the proposed method.

34 Claims, 3 Drawing Sheets

(52) U.S. Cl.
CPC ..... *H04R 25/453* (2013.01); *H04R 2460/03* (2013.01); *H04R 2460/05* (2013.01)

(58) Field of Classification Search
CPC ..... H04R 2225/025; H04R 2225/43; H04R 2460/03; H04R 2460/05; H04R 1/10; H04R 1/1016
See application file for complete search history.

(56) References Cited

U.S. PATENT DOCUMENTS

| | | | | |
|---|---|---|---|---|
| 2008/0107287 | A1* | 5/2008 | Beard | H04R 1/1016 381/111 |
| 2009/0010442 | A1 | 1/2009 | Usher | |
| 2010/0260364 | A1* | 10/2010 | Merks | H04R 25/407 381/313 |

FOREIGN PATENT DOCUMENTS

| | | | |
|---|---|---|---|
| WO | 2004/021740 | A1 | 3/2004 |
| WO | 2004/077090 | A1 | 9/2004 |

* cited by examiner

METHOD FOR OPERATING A HEARING DEVICE AND A HEARING DEVICE

TECHNICAL FIELD

The present invention is related to a method for operating a hearing device as well as to a hearing device adapted to perform the method. In particular, the present invention is directed at detecting a hearing device user's voice activity, i.e. so-called "own-voice detection", to be used in conjunction with operating a hearing device.

BACKGROUND OF THE INVENTION

A frequent complaint of users of hearing devices, especially when they start wearing them for the first time, is that the sound of their own voice is too loud or that it sounds like they are talking into a barrel. Both effects are particularly pronounced when the ear canal (commonly also referred to as the auditory canal) is sealed, e.g. by an otoplastic. Accordingly, there exists the need to identify the presence or activity of the own voice of the user of a hearing device to be able to process the user's own voice in a different way than sound originating from other sources.

Methods for own-voice detection are commonly based on quantities that can be derived from a single microphone signal measured at an ear of a user, such as for example overall level, pitch, spectral shape, spectral comparison of auto-correlation and auto-correlation of predictor coefficients, cepstral coefficients, prosodic features, or modulation metrics. However, the degree of achieving reliable own-voice detection is rather poor when using methods based on such measures.

EP 1 956 589 A1 discloses a method for identifying the user's own voice by assessing a direct-to-reverberant ratio between the signal energy of a direct sound part and that of a reverberant sound part of at least a portion of a recorded sound. It is stated that this allows a very reliable own-voice detection. However, to achieve this a rather complex signal analysis is required.

WO 2004/077090 discloses a method for detection of own voice activity in a communication system which seeks to improve detection reliability. Hereto, own-voice detection is based on a combination of a number of individual detectors, each of which may be error-prone, whereas the combined detector is asserted to be robust. A signal processing unit is utilised to receive signals from at least two microphones worn on the user's head, which are then processed so as to distinguish as well as possible between sound from the user's mouth and sounds originating from other sources. The distinction is based on the specific characteristics of the sound field produced by own voice, which are due to the fact that the microphones are in the acoustical near-field of the hearing device user's mouth and in the far-field of the other sources of sound, and that arise because the mouth is located symmetrically with respect of the user's head. The combined detector then detects the presence of own-voice when each of the individual characteristics of the signal are in respective ranges. This method too has a relatively high complexity.

Alternatively, a transducer which picks up vibrations within the ear canal caused by vocal activity of the user can be employed.

U.S. Pat. No. 6,041,129 discloses a hearing aid which uses an accelerometer or other rigid body motion sensor attached to the surface of the hearing aid at a point where it most closely comes in contact with the solid portion of the auditory canal. In this way, the accelerometer can sense directly the conductive sound waves created by the user's own voice. Such sound waves can then be either amplified or attenuated, and subsequently mixed with air-borne sound detected by the microphone depending on the user's needs.

US 2007/0009122 A1 discloses a method of own-voice detection achieved by providing a microphone in the auditory channel whose signal level is compared with that of an external microphone.

SUMMARY OF THE INVENTION

It is an object of the present invention to provide a method for operating a hearing device which performs own-voice detection in a reliable and simple manner.

Within the context of the present invention hearing devices for instance comprise hearing aids, such as in-the-ear (ITE), completely-in-canal (CIC) or behind-the-ear (BTE) hearing aids, earphones, hearing protection devices, as well as ear-level communication, noise reduction and sound enhancement devices.

The object of the invention is achieved by the method according to claim 1 and by the hearing device according to claim 18. Specific embodiments are provided in the dependent claims.

The present invention is first directed to a method for operating a hearing device comprising at least one ambient microphone, a signal processing unit, a receiver and an ear canal microphone, the method comprising the steps of:

- picking up an ambient sound at an input of the at least one ambient microphone which provides a first audio signal at an output of the at least one ambient microphone representing the ambient sound;
- processing the first audio signal in the signal processing unit which provides a processed audio signal;
- applying the processed audio signal to an input of the receiver which outputs at an output of the receiver sound into an ear canal of a user of the hearing device;
- picking up an ear canal internal sound at an input of the ear canal microphone which provides a second audio signal at an output of the ear canal microphone representing the ear canal internal sound;
- filtering the processed audio signal with a first filter having a transfer function at least comprising a transfer function from the output of the receiver to the input of the ear canal microphone when the hearing device is turned on and being worn in an ear canal of the user, the first filter providing a filtered processed audio signal;
- computing a difference between the second audio signal and the filtered processed audio signal resulting in a third audio signal; and
- detecting a presence of own-voice of the user based on the third audio signal.

An ear canal microphone refers to any type of sound pressure sensor, including for instance a piezo sensor or an accelerometer, intended to be located within the ear canal of the user during use of the hearing device.

A transfer function G(f) at least comprising a transfer function T(f) from a first signal port A to a second signal port B refers to a transfer function G(f) that is representative of the transfer function T(f) and could possibly comprise one or more further transfer functions T'(f), T"(f), . . . , e.g. $G(f)=T(f)\cdot T'(f)\cdot T''(f)$, f being frequency, T'(f) for instance being a transfer function of a receiver, and T"(f) for instance being a transfer function of an ear canal microphone, such that the transfer function G(f) is representative of an overall transfer function $T_{tot}(f)$ from a third signal port C, located "upstream" from signal port A (e.g. a receiver input), to a fourth signal port D, located "downstream" from signal port B (e.g. an ear canal microphone output).

In an embodiment of the present invention the transfer function of the first filter at least comprises a transfer function from the input of the receiver to the output of the ear canal microphone when the hearing device is turned on and being worn in an ear canal of the user, i.e. the transfer function of the first filter further includes the transfer functions of the receiver and the transfer function of the ear canal microphone.

In this way an estimate of the sound component within the ear canal originating from the receiver is taken into account and removed from the second audio signal provided by the ear canal microphone. This yields a good approximation of the own-voice signal possibly present within the ear canal based upon which own-voice activity can be discerned.

In a further embodiment of the method the step of detecting is further based on the first audio signal. In this way the ambient sound component, consisting of sound from the user's environment as well as possibly of the user's voice originating from his mouth, which enters the ear canal, e.g. via a vent of the hearing device, is taken into account. By for instance additionally removing the ambient sound component from the second audio signal provided by the ear canal microphone, an improved approximation of the own-voice signal present within the ear canal can be achieved, thus yielding an improved detection of own-voice activity.

In a further embodiment the method further comprises the step of filtering the first audio signal with a second filter having a transfer function representative of a real-ear occluded gain (REOG) transfer function, the second filter providing a filtered first audio signal. A real-ear occluded gain (REOG) transfer function is defined from the output of the ambient microphone to the output of the ear canal microphone while the hearing device is inserted in the ear canal of the user. The REOG transfer function can for example be determined by comparing the output signals of the ambient microphone and the ear canal microphone when the receiver of the hearing device is turned off or muted. By doing this an improved estimate of the ambient sound component is achieved by taking into account the way the ambient sound component is affected by for instance the vent or other direct sound paths from the outside of the ear canal past the hearing device towards the ear drum (also referred to as tympanic membrane). In this way a further improved detection of own-voice activity is achieved.

In a further embodiment of the method filtering the first audio signal is carried out in the log/dB domain, e.g. by simply subtracting a magnitude expressed in decibels (and not considering phase). Since the phase of the real-ear occluded gain (REOG) transfer function is typically not known precisely, performing only frequency-dependent amplitude weighting simplifies the filtering process.

In a further embodiment of the method the second filter is adapted online, i.e. in real-time, during operation of the hearing device, for instance by means of a least mean squares (LMS) algorithm. In this way the time-variability of the REOG transfer function due to variations of the ear canal geometry for instance caused by movements of the jaw are taken into account. Moreover, different positioning/seating of the hearing device within the ear canal as well as for instance clogging of the vent with earwax (cerumen) or debris can be taken into account in this way.

In a further embodiment of the method the transfer function of the second filter is determined based on a first measurement of the REOG transfer function, the first measurement for instance being made when the hearing device is fitted to the needs of the user.

In a further embodiment of the method the transfer function of the second filter is determined based on at least one further measurement of the real-ear occluded gain (REOG) transfer function, the at least one further measurement for instance being made when the hearing device and/or the jaw of the user is positioned differently compared to that when the first measurement was made. In this way an average REOG transfer function can be determined for the user.

In a further embodiment of the method the first filter is adapted online, i.e. in real-time, during operation of the hearing device, for instance by means of a further least mean squares (LMS) algorithm. In this way the time-variability of the sound transmission within the ear canal from the receiver to the ear canal microphone due to variations of the ear canal geometry for instance caused by movements of the jaw are taken into account. Moreover, different positioning/seating of the hearing device within the ear canal as well as for instance clogging of the vent with earwax (cerumen) or debris can be taken into account in this way.

In a further embodiment of the method the transfer function of the first filter is determined based on an initial measurement of the transfer function from the output (or input) of the receiver to the input (or output) of the ear canal microphone when the hearing device is turned on and being worn in the ear canal of the user, the initial measurement for instance being made when the hearing device is fitted to the needs of the user.

In a further embodiment of the method the transfer function of the first filter is determined based on at least one additional measurement of the transfer function from the output (or input) of the receiver to the input (or output) of the ear canal microphone when the hearing device is turned on and being worn in the ear canal of the user, the at least one additional measurement for instance being made when the hearing device and/or the jaw of the user is positioned differently compared to that when the initial measurement was made. In this way an average transfer function from the receiver to the ear canal microphone can be determined for the user.

In a further embodiment of the method the step of detecting comprises determining a first power estimate of the third audio signal.

In a further embodiment of the method the step of detecting comprises determining a second power estimate of the first audio signal or of the filtered first audio signal.

In a further embodiment of the method determining the first and/or the second power estimate comprises at least one of squaring, determining an absolute value, conversion into decibels, and low-pass filtering.

In a further embodiment of the method the step of detecting the presence of own-voice comprises one of:

- comparing the first power estimate with the second power estimate;
- subtracting the second power estimate from the first power estimate.

In a further embodiment of the method the step of detecting the presence of own-voice is dependent on a "characteristic curve"/"discriminator function", such as for instance a step function, a ramp function (with a lower and an upper threshold value), a sigmoid function, or a hysteresis function. In this way for instance a binary function discerning that own-voice is either "present" or "absent" can be assigned. Frequent, uncertain toggling between these two states can be prevented by introducing a hysteresis. Alternatively, a probability, e.g. a value between 0 and 1, can be assigned to the detection of own-voice. Smoothing, averaging or low-pass filtering can also be applied as part of the step of detecting in order to avoid rapid fluctuations in the output of the detection process.

In a further embodiment of the method the hearing device further comprises at least one of an active occlusion control unit, a classifier (i.e. a classification unit), a gain model, a noise canceller, a beamformer, a reverberation canceller, and a wind noise canceller, and the method further comprises the step of controlling at least one of the active occlusion control unit, the classifier, the gain model, the noise canceller, the beamformer, the reverberation canceller, and the wind noise canceller dependent on the presence of own-voice.

In a further embodiment of the method controlling the active occlusion control unit comprises turning off the active occlusion control unit when the presence of own-voice is not detected. By doing so possible artefacts introduced by the active occlusion control unit can be reduced and furthermore power can be saved by operating the active occlusion control unit only in those instances when own-voice is actually considered present.

Moreover, the present invention is further directed to a hearing device comprising:

at least one ambient microphone, a signal processing unit, a receiver, an ear canal microphone, and an own-voice detection unit characterised in comprising:

a first filter having a transfer function at least comprising a transfer function from an output (or input) of the receiver to an input (or output) of the ear canal microphone when the hearing device is turned on and being worn in an ear canal of the user, a subtractor, and detector, wherein an output of the at least one ambient microphone is connected to an input of the signal processing unit, an output of the signal processing unit is connected to an input of the receiver as well as to an input of the first filter, an output of the first filter and an output of the ear canal microphone are connected to inputs of the subtractor, which is adapted to provide at an output of the subtractor a difference between an output signal of the ear canal microphone and an output signal of the first filter, the output of the subtractor being connected to an input of the detector, the detector being adapted to detect a presence of own-voice of the user based on a signal provided at the input of the detector.

In an embodiment of the hearing device the output of the ambient microphone is further connected to a further input of the detector, and wherein the detector is adapted to detect a presence of own-voice of the user further based on a signal provided at the further input of the detector.

In a further embodiment the hearing device further comprises a second filter having a transfer function representative of a real-ear occluded gain (REOG) transfer function, specifically a transfer function from the input of the ambient microphone to the input of the ear canal microphone when the hearing device is turned off and being worn by the user in the ear canal, wherein the output of the ambient microphone is connected to an input of the second filter and an output of the second filter is connected to the further input of the detector.

In a further embodiment of the hearing device the second filter is adapted to perform filtering in the log/dB domain.

In a further embodiment of the hearing device the second filter is adaptable online, i.e. in real-time, during operation of the hearing device, for instance by means of a least mean squares (LMS) algorithm.

In a further embodiment of the hearing device the transfer function of the second filter is based on a first measurement of the REOG transfer function, the first measurement for instance being made when the hearing device is fitted to the needs of the user.

In a further embodiment of the hearing device the transfer function of the second filter is based on at least one further measurement of the REOG transfer function, the at least one further measurement for instance being made when the hearing device and/or the jaw of the user is positioned differently compared to that when the first measurement was made.

In a further embodiment of the hearing device the first filter is adaptable online, i.e. in real-time, during operation of the hearing device, for instance by means of a further least mean squares (LMS) algorithm.

In a further embodiment of the hearing device the transfer function of the first filter is based on an initial measurement of the transfer function from the output (or input) of the receiver to the input (or output) of the ear canal microphone when the hearing device is turned on and being worn in the ear canal of the user, the initial measurement for instance being made when the hearing device is fitted to the needs of the user.

In a further embodiment of the hearing device the transfer function of the first filter is based on at least one additional measurement of the transfer function from the output (or input) of the receiver to the input (or output) of the ear canal microphone when the hearing device is turned on and being worn in the ear canal of the user, the at least one additional measurement for instance made when the hearing device and/or the jaw of the user is positioned differently compared to that when the initial measurement was made.

In a further embodiment of the hearing device the detector comprises a first power estimator adapted to determine a power estimate of the signal provided at the input of the detector.

In a further embodiment of the hearing device the detector comprises a second power estimator adapted to determine a power estimate of the signal provided at the further input of the detector.

In a further embodiment of the hearing device the first and/or the second power estimator comprises at least one of a squaring unit, an absolute value unit, a conversion into decibels unit, and a low-pass filter.

In a further embodiment of the hearing device the detector comprises at least one of:

a comparator unit for comparing the first power estimate with the second power estimate;

a further subtractor for computing a difference between the first power estimate and the second power estimate.

In a further embodiment of the hearing device the detector is adapted to detect the presence of own-voice of the user dependent on a "characteristic curve" / "discriminator function", such as for instance a step function, a ramp function, a sigmoid function, or a hysteresis function.

In a further embodiment the hearing device further comprises at least one of an active occlusion control unit, a classifier, a gain model, a noise canceller, a beamformer, a reverberation canceller, a wind noise canceller, and a controller adapted to control at least one of the active occlusion control unit, the classifier, the gain model, the noise canceller, the beamformer, the reverberation canceller, and the wind noise canceller dependent on the presence of own-voice.

In a further embodiment of the hearing device the controller is adapted to turn off the active occlusion control unit when the presence of own-voice is not detected.

It is pointed out that combinations of the above-mentioned embodiments give rise to even further, more specific embodiments according to the present invention.

BRIEF DESCRIPTION OF THE DRAWINGS

The present invention is further explained below by means of non-limiting specific embodiments and with reference to the accompanying drawings. What is shown in the figures is the following.

In the figures, like reference signs refer to like parts.

DETAILED DESCRIPTION OF THE INVENTION

Depending on the application a hearing device is intended for, either an "open" or a "closed" fitting is employed. In the former case sound is delivered to the ear drum of the user both directly, i.e. by-passing the hearing device, as well as for instance via a thin tube extending into the ear canal conveying sound that has been processed, e.g. amplified, by the hearing device. In this way it is possible to maintain the user's voice sounding natural for the user himself, however only relatively mild amplification can be applied, otherwise feedback whistling will occur. On the other hand, when high levels of amplification are required, e.g. to compensate a severe hearing loss, or a great degree of ambient sound attenuation is desired, e.g. for a hearing protection device, a closed fitting is necessary, where the ear canal is essentially sealed-off, i.e. very little direct sound reaches the ear drum. This has the disadvantage of causing the so-called "occlusion effect", which occurs when an object blocks a person's ear canal, and the person perceives his/her own voice as "hollow" or "booming", such as when talking into a barrel. This annoying effect can be mitigated for instance by means of active occlusion control.

Figure 1:
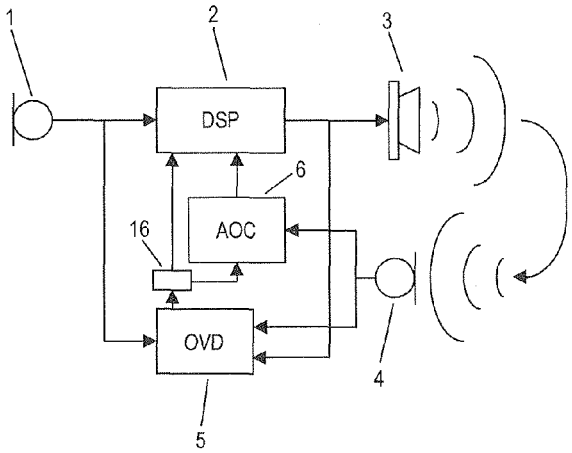
FIG. 1 schematically depicts a high-level block diagram of an exemplary hearing device comprising an active occlusion control (AOC) unit and an own-voice detection (OVD) unit according to the present invention.

FIG. 1 shows a high-level block diagram of a hearing device including means for active occlusion control. Sound from the surroundings of the hearing device user are picked up by an ambient microphone 1, e.g. located at the outward facing end of the hearing device when worn at least partially within an ear canal of the user. The audio signal from the ambient microphone 1 is processed by a signal processing unit 2, which for instance performs frequency-dependent amplification, noise cancelling and beamforming (the latter requiring at least two microphones in order to achieve directional filtering). The processed audio signal is then applied to a receiver 3 (i.e. a miniature loudspeaker) which emits sound towards the ear drum. In order to combat the occlusion effect, ear canal internal sound is picked up by an ear canal microphone 4 located within the ear canal, i.e. arranged at the inward facing end of the hearing device or ear piece of the hearing device. The signal provided by the ear canal microphone 4 is then processed by the active occlusion control (AOC) unit 6, for instance comprising a suitably chosen occlusion filter, which generates a signal that is combined with (e.g. added to) the processed version of the audio signal from the ambient microphone 1 and output by the receiver 3. The filter is selected/adjusted dependent on the transfer function from the input to the receiver 3 to the output of the ear canal microphone 4, i.e. according to the specific "plant" present between the receiver 3 and the ear canal microphone 4 when the hearing device is being worn by the user. In particular the plant comprises the influences of the specific user's ear canal, tympanic membrane and middle ear, as well as the low-frequency roll-off caused by the effective vent including leakage due to a possible bad seat (i.e. non-optimal sealing-off) of the hearing device in the ear canal.

As is apparent from FIG. 1 the AOC operates in a closed-loop setup, so there is an inherent danger of system instability, manifested as "whistling" (similar to the whistling due to an improperly working feedback canceller) or "humming". This can for instance occur due to a much better seat (i.e. increased sealing-off) of the hearing device within the ear canal than during the fitting process of the hearing device, or due to a blocked vent because of cerumen or other debris. In order to prevent such instabilities, the plant must be monitored. Knowledge of the presence of own-voice can be helpful as part of such an AOC monitoring process. Furthermore, it is beneficial to only turn on the AOC unit 6 when own-voice is actually present, because on the one hand unnecessary AOC processing can be avoided which saves power, and on the other hand the AOC processing can give rise to unpleasant audible artefacts, so these should be avoided especially in situations where no own-voice is present. Detecting the presence or absence of own-voice is thereby achieved by means of the own-voice detection (OVD) unit 5, the output of which is provided to a controller 16, which for instance turns off the AOC unit 6 whenever there is no own-voice activity, i.e. when the user is not speaking or generating other "body sounds" such as chewing, swallowing, coughing, etc.

Figure 2:
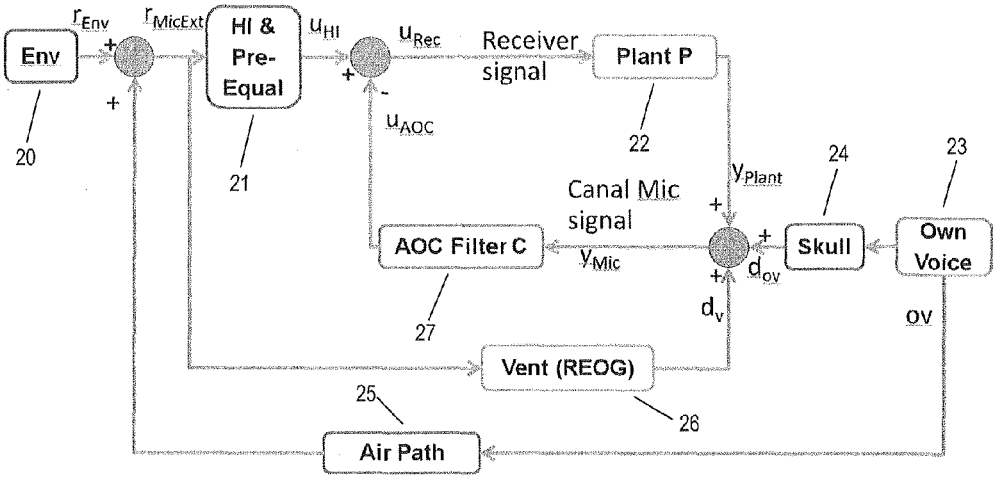
FIG. 2 schematically depicts a block diagram of an exemplary setup for performing active occlusion control (AOC) showing various contributions to the sound picked up by the ear canal microphone.

FIG. 2 depicts various contributions to the audio signal $y_{Mic}$ provided by the ear canal microphone 4. The ear canal internal sound picked up by the ear canal microphone 4 consists of:

a) sound originating from the receiver 3 that traverses the plant 22, i.e. is filtered by the transfer function of the plant 22, represented by the signal $y_{Plant}$, b) direct sound originating from the exterior of the ear canal that by-passes the hearing device, e.g. enters the ear canal through a vent 26 or a leaky seal, represented by the signal $d_v$, and c) speech and body sounds OV generated by the user entering the ear canal through its cartilaginous wall (from the skull 24), giving rise to an occlusion signal $d_{OV}$ (=own-voice).

The sound $u_{Rec}$ emitted by the receiver 3, which passes through the plant 22, consists of a component $r_{MicExt}$ picked up by the ambient microphone 1 and processed, e.g. amplified 21, by the signal processing unit 2, and of a component $u_{AOC}$ picked up by the ear canal microphone 4 and processed, e.g. AOC filtered 27, by the AOC unit 6. The component $r_{MicExt}$ picked up by the ambient microphone 1 in turn consists of ambient sound $r_{Env}$ from the user's environment 20 and possibly also of speech OV of the user's own voice 23 originating from his mouth and reaching the ambient microphone 1 via an external air path 25. The direct sound $d_v$ which by-passes the hearing device is influenced by the real-ear occluded gain (REOG) transfer function.

The task of the own-voice detection (OVD) unit 5 is to detect the occlusion (own-voice) signal $d_{OV}$ given only measurements of the aggregate signal, i.e. the sum of all the contributions $y_{Mic}=y_{Plant}+d_{OV}+d_v$.

Figure 3:
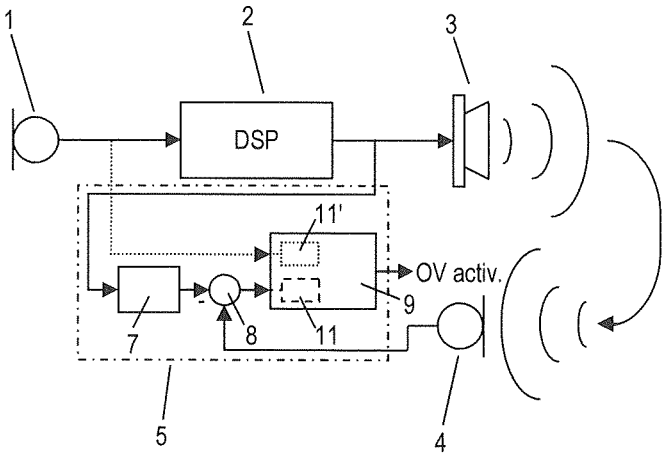
FIG. 3 schematically depicts a block diagram of a hearing device with an exemplary OVD unit according to a first embodiment of the present invention.

FIG. 3 shows a block diagram of a hearing device with an OVD unit 5 according to a first embodiment. As can be seen, the output signal from the signal processing unit 2 is provided to the OVD unit 5 (=block depicted in dash-dotted lines), wherein it is supplied to the filter 7 having a transfer function at least comprising the transfer function from an input of the receiver 3 to an output of the ear canal microphone 4 when the hearing device is turned on and being worn in an ear canal of the user, i.e. an approximation of the transfer function of the plant 22. The filtered signal, which is an estimate y' of the sound signal from the plant 22, is then subtracted from the signal provided by the ear canal microphone 4 by means of the subtractor 8, the difference signal ($y_{Mic}-y'\approx d_{OV}+d_v$) being applied to the detector 9, which is configured to detect the presence of own-voice of the user based on this difference signal. However, this difference signal still includes a component due to the direct sound signal $d_v$, which can degrade the performance of the OVD unit 5.

An improved variant of this embodiment is obtained by averaging the difference signal or by determining a power estimate of the difference signal by means of the power estimator 11 (depicted in FIG. 3 as a possible option by the block indicated with dashed lines).

A further improved variant is obtained by additionally providing the signal from the ambient microphone 1 to the detector 9. This signal can then be subtracted from the difference signal, the averaged difference signal or the power estimate of the difference signal.

In yet a further improved variant the signal from the ambient microphone 1 is averaged or a power estimate thereof determined by means of the further power estimator 11' (depicted in FIG. 3 as a possible further option by the block indicated with dotted lines) before subtracting it from the difference signal. The detector 9 outputs an own-voice activity signal, which can for instance be the result of a binary decision with the two possible outcomes own-voice present/active or absent/inactive. Instead, the own-voice activity signal can provide a probability of own-voice being present/absent in the form of a value between 0 and 1 (or 0 and 100%).

Figure 4:
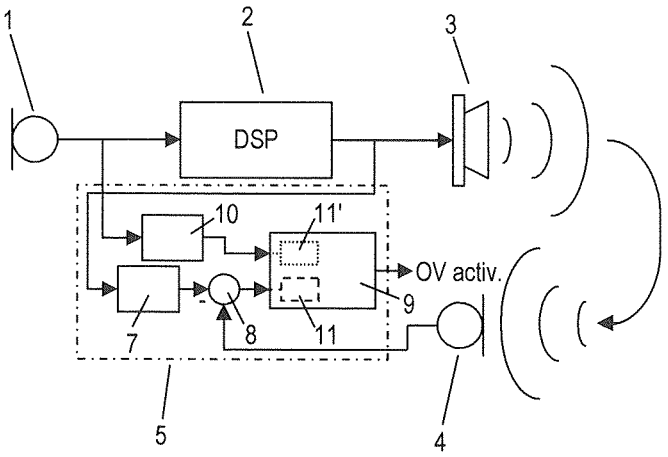
FIG. 4 schematically depicts a block diagram of a hearing device with an exemplary OVD unit according to a further embodiment of the present invention.

FIG. 4 shows a block diagram of a hearing device with an OVD unit 5 according to a further embodiment having improved performance, because it additionally takes into account the direct sound signal $d_v$. In addition to the embodiment shown in FIG. 3 the signal from the ambient microphone 1 is applied to the further filter 10 having a transfer function, which is an approximation of the real-ear occluded gain (REOG) transfer function. This takes into account that only low frequencies (below about 500 Hz) are transmitted without significant attenuation into the ear canal. The filter 10 can optionally be time-varying and adapted online (in real-time), for instance via an LMS algorithm, and furthermore be dependent on various sounds or signals of the signal processing unit, e.g. the adaptation speed could be set dependent on the current situation or the structure of the filter 10 could be changed dependent on the required precision. Moreover, the REOG filtering can optionally be carried out in the log/dB domain, e.g. by simply subtracting a magnitude expressed in decibels, as the phase of the REOG transfer function is not known precisely. The output signal of the filter 10, which is a good estimate $d_v'$ of the direct sound $d_v$, is then also supplied to the detector 9. The detector 9 can then determine an estimate $d_{OV}'$ of the occlusion signal (=own-voice) $d_{OV}$ by calculating the difference between the two signals supplied to the detector 9 ($d_{OV}'=(y_{Mic}-y')-d_v'$). Again the estimate of the occlusion signal $d_{OV}'$ can be improved by averaging or by determining power estimates of the two input signals applied to the detector 9, as indicated by the two optional blocks 11 and 11'.

Figure 5:
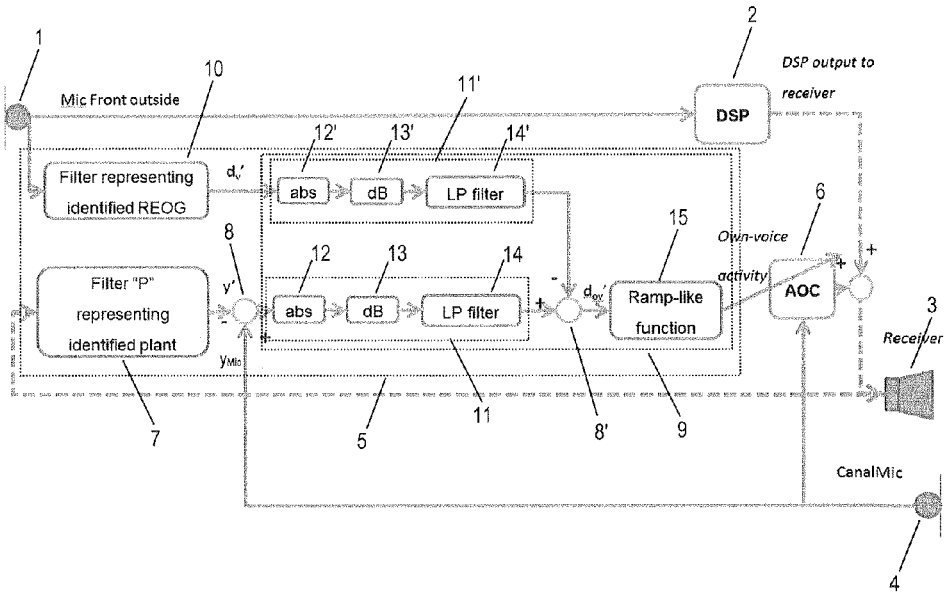
FIG. 5 schematically depicts a block diagram of a hearing device with an exemplary OVD unit according to yet a further embodiment of the present invention.

FIG. 5 shows a detailed block diagram of a hearing device with an OVD unit 5 according to a more specific embodiment. Here especially the detector 9 is illustrated in detail. It comprises two power estimators 11, 11', a further subtractor 8' and a ramp-like discrimination function 15 which provides a value indicative of the own-voice activity, e.g. a probability that own-voice is active. The first power estimator 11 estimates the power of the difference signal between the output of the ear canal microphone 4 and the output of the filter 7 approximating the transfer function of the plant 22. The second power estimator 11' estimates the power of the filter 10 approximating the REOG transfer function 26. Both power estimators 11 and 11' each comprise blocks that perform an "absolute value" operation 12, 12', a conversion into the log/decibel domain 13, 13', and low-pass filtering 14, 14' (possibly time-varying). The outputs of the two power estimators 11, 11' are applied to the subtractor 8', yielding a difference signal which is an estimate of the occlusion signal $d_{OV}'$. This estimate $d_{OV}'$! is then applied to a "discriminator function" or "characteristic curve" 15, which provides a mapping of input occlusion signal $d_{OV}'$ to output own-voice activity.

Figure 6:
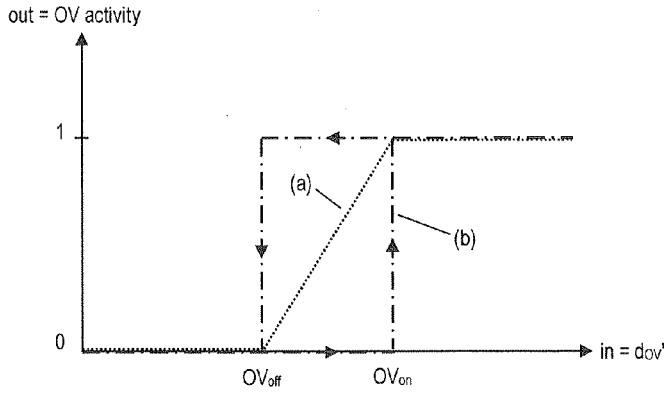
FIG. 6 schematically shows two exemplary "characteristic curves"/"discriminator functions" for detecting the presence of own-voice, namely (a) a ramp function (=dash-dotted graph), and (b) a hysteresis function (=dotted graph).

Two such exemplary mappings/functions are illustrated in FIG. 6. The dotted curve (a) is a ramp-function, which assigns a value of 0 (=OV absent) to the OV activity output when the occlusion signal $d_{OV}'$ is below a lower threshold $OV_{off}$, a value of 1 (=OV present) to the OV activity output when the occlusion signal $d_{OV}'$ is above an upper threshold $OV_{on}$, and a value between 0 and 1 to the OV activity output when the occlusion signal $d_{OV}'$ lies between the lower and the upper threshold $OV_{off}$ and $OV_{on}$. This transition between the two thresholds $OV_{off}$ and $OV_{on}$ allows to characterise a degree of (un-)certainty that own-voice is present/absent. Alternatively, the dash-dotted curve (b) is a hysteresis-function, which assigns a binary value of 0 (=OV absent) or 1 (=OV present) to the OV activity output. Furthermore, frequent, uncertain toggling between these two values is prevented by forcing the OV activity output to maintain a value of 1 until it drops below the lower threshold $OV_{off}$ and to maintain a value of 0 until it exceeds the upper threshold $OV_{on}$.

According to the method and hearing device of the present invention the various components $y_{Plant}$, $d_V$ and $d_{OV}$ of the sound within the ear canal that is picked up by the ear canal microphone 4 are identified and separated from one another in a systematic manner. In particular, a model of the plant 22 is used, and furthermore the direct sound entering the ear canal via leaks in the seal of the hearing device or via vents provided in the hearing device is for instance filtered by the REOG transfer function. The output of the OVD unit 5 is then for example employed to control the activity of the AOC unit 6 or other parts of the signal processing, e.g. classifier, gain model, noise canceller, beamformer, reverberation canceller and/or wind noise canceller, carried out by the signal processing unit 2. It is thus for instance possible to decrease the power consumption of the hearing device or to reduce artefacts generated by the AOC unit 6 by only turning it on when the OVD unit 5 indicates that own-voice is determined to be present.

What is claimed is:

1. A method for operating a hearing device comprising an ambient microphone (1), a signal processing unit (2), a receiver (3) and an ear canal microphone (4), the method comprising the steps of:

picking up an ambient sound at an input of the ambient microphone (1) which provides a first audio signal at an output of the at least one ambient microphone (1) representing the ambient sound;

processing the first audio signal in the signal processing unit (2) which provides a processed audio signal;

applying the processed audio signal to an input of the receiver (3) which outputs at an output of the receiver (3) sound into an ear canal of a user of the hearing device;

picking up an ear canal internal sound at an input of the ear canal microphone (4) which provides a second audio signal at an output of the ear canal microphone (4) representing the ear canal internal sound;

characterised by filtering the processed audio signal with a first filter (7) having a transfer function at least comprising a transfer function from the output of the receiver (3) to the input of the ear canal microphone (4) when the hearing device is turned on and being worn in an ear canal of the user, the first filter (7) providing a filtered processed audio signal;

computing a difference between the second audio signal and the filtered processed audio signal resulting in a third audio signal; and detecting a presence of own-voice of the user based on the third audio signal.

2. The method of claim 1, wherein the step of detecting is further based on the first audio signal.

3. The method of claim 2, further comprising the step of filtering the first audio signal with a second filter (10) having a transfer function representative of a real-ear occluded gain transfer function, specifically a transfer function from the output of the ambient microphone (1) to the output of the ear canal microphone (4) when the hearing device is turned off and being worn by the user in the ear canal, the second filter (10) providing a filtered first audio signal.

4. The method of claim 3, wherein filtering the first audio signal is carried out in the log/dB domain by means of a subtraction.

5. The method of claim 3, wherein the second filter (10) is adapted online during operation of the hearing device by means of a least mean squares algorithm.

6. The method of claim 3, wherein the transfer function of the second filter (10) is determined based on a first measurement of the real-ear occluded gain transfer function, the first measurement made when the hearing device is fitted to the needs of the user.

7. The method of claim 6, wherein the transfer function of the second filter (10) is determined based on at least one further measurement of the real-ear occluded gain transfer function, the at least one further measurement made when the hearing device and/or the jaw of the user is positioned differently compared to that when the first measurement was made.

8. The method of claim 1, wherein the first filter (7) is adapted online during operation of the hearing device by means of a further least mean squares algorithm.

9. The method of claim 1, wherein the transfer function of the first filter (7) is determined based on an initial measurement of the transfer function from the output of the receiver (3) to the input of the ear canal microphone (4) when the hearing device is turned on and being worn in the ear canal of the user, the initial measurement made when the hearing device is fitted to the needs of the user.

10. The method of claim 9, wherein the transfer function of the first filter (7) is determined based on at least one additional measurement of the transfer function from the output of the receiver (3) to the input of the ear canal microphone (4) when the hearing device is turned on and being worn in the ear canal of the user, the at least one additional measurement made when the hearing device and/or the jaw of the user is positioned differently compared to that when the initial measurement was made.

11. The method of claim 1, wherein the step of detecting comprises determining a first power estimate of the third audio signal.

12. The method of claim 11, wherein determining the first and/or the second power estimate comprises at least one of squaring, determining an absolute value, conversion into decibels, and low-pass filtering.

13. The method of claim 1, wherein the step of detecting comprises determining a second power estimate of the first audio signal or of the filtered first audio signal.

14. The method of claim 13, wherein the step of detecting the presence of own-voice comprises one of:

comparing the first power estimate with the second power estimate;

computing a difference between the first power estimate and the second power estimate.

15. The method of claim 1, wherein the step of detecting the presence of own-voice is dependent on a discriminator function including one of the following: a step function, a ramp function, a sigmoid function, or a hysteresis function.

16. The method of claim 1, wherein the hearing device further comprises at least one of an active occlusion control unit (6), a classifier, a gain model, a noise canceller, a beamformer, a reverberation canceller, and a wind noise canceller, and wherein the method further comprises the step of controlling at least one of the active occlusion control unit (6), the classifier, the gain model, the noise canceller, the beamformer, the reverberation canceller, and the wind noise canceller dependent on the presence of own-voice.

17. The method of claim 16, wherein controlling the active occlusion control unit (6) comprises turning off the active occlusion control unit (6) when the presence of own-voice is not detected.

18. A hearing device comprising:

an ambient microphone (1) located at an outward facing end of the hearing device when worn at least partially within an ear canal of a user, a signal processing unit (2), a receiver (3), an ear canal microphone (4) located within the ear and arranged at an inward facing end of the hearing device when worn at least partially within the ear canal of the user, and an own-voice detection unit (5) characterised in comprising:

a first filter (7) having a transfer function at least comprising a transfer function from an output of the receiver (3) to an input of the ear canal microphone (4) when the hearing device is turned on and being worn in an ear canal of the user, a subtractor (8), and detector (9), wherein an output of the ambient microphone (1) is connected to an input of the signal processing unit (2), an output of the signal processing unit (2) is connected to an input of the receiver (3) as well as to an input of the first filter (7), an output of the first filter (7) and an output of the ear canal microphone (4) are connected to inputs of the subtractor (8), which is adapted to provide at an output of the subtractor (8) a difference between an output signal of the ear canal microphone (4) and an output signal of the first filter (7), the output of the subtractor (8) being connected to an input of the detector (9), the detector (9) being adapted to detect a presence of own-voice of the user based on a signal provided at the input of the detector (9).

19. The hearing device of claim 18, wherein the output of the ambient microphone (1) is further connected to a further input of the detector (9), and wherein the detector (9) is adapted to detect a presence of own-voice of the user further based on a signal provided at the further input of the detector (9).

20. The hearing device of claim 19, further comprising a second filter (10) having a transfer function representative of a real-ear occluded gain transfer function, specifically a transfer function from the output of the ambient microphone (1) to the output of the ear canal microphone (4) when the hearing device is turned off and being worn by the user in the ear canal, wherein the output of the ambient microphone (1) is connected to an input of the second filter (10) and an output of the second filter (10) is connected to the further input of the detector (9).

21. The hearing device of claim 20, wherein the second filter is adapted to perform filtering in the log/dB domain.

22. The hearing device of claim 20, wherein the second filter (10) is adaptable online during operation of the hearing device by means of a least mean squares algorithm.

23. The hearing device of claim 20, wherein the transfer function of the second filter (10) is based on a first measurement of the real-ear occluded gain transfer function, the first measurement made when the hearing device is fitted to the needs of the user.

24. The hearing device of claim 23, wherein the transfer function of the second filter (10) is based on at least one further measurement of the real-ear occluded gain transfer function, the at least one further measurement made when the hearing device and/or the jaw of the user is positioned differently compared to that when the first measurement was made.

25. The hearing device of claim 18, wherein the first filter (7) is adaptable online during operation of the hearing device by means of a further least mean squares algorithm.

26. The hearing device of claim 18, wherein the transfer function of the first filter (7) is based on an initial measurement of the transfer function from the output of the receiver (3) to the input of the ear canal microphone (4) when the hearing device is turned on and being worn in the ear canal of the user, the initial measurement made when the hearing device is fitted to the needs of the user.

27. The hearing device of claim 26, wherein the transfer function of the first filter (7) is based on at least one additional measurement of the transfer function from the output of the receiver (3) to the input of the ear canal microphone (4) when the hearing device is turned on and being worn in the ear canal of the user, the at least one additional measurement made when the hearing device and/or the jaw of the user is positioned differently compared to that when the initial measurement was made.

28. The hearing device of claim 18, wherein the detector (9) comprises a first power estimator (11) adapted to determine a power estimate of the signal provided at the input of the detector (9).

29. The hearing device of claim 28, wherein the first and/or the second power estimator (11, 11') comprises at least one of a squaring unit, an absolute value unit (12, 12'), a conversion into decibels unit (13, 13'), and a low-pass filter (14, 14').

30. The hearing device of claim 18, wherein the detector (9) comprises a second power estimator (11') adapted to determine a power estimate of the signal provided at the further input of the detector (9).

31. The hearing device of claim 30, wherein the detector (9) comprises at least one of:

a comparator unit for comparing the first power estimate with the second power estimate; and a further subtractor (8') for computing a difference between the first power estimate and the second power estimate.

32. The hearing device of claim 18, wherein the detector (9) is adapted to detect the presence of own-voice of the user dependent on a discriminator function including one of the following: a step function, a ramp function, a sigmoid function, or a hysteresis function.

33. The hearing device of claim 18, further comprising at least one of an active occlusion control unit (6), a classifier, a gain model, a noise canceller, a beamformer, a reverberation canceller, a wind noise canceller, and a controller (16) adapted to control at least one of the active occlusion control unit (6), the classifier, the gain model, the noise canceller, the beamformer, the reverberation canceller, and the wind noise canceller dependent on the presence of own-voice.

34. The hearing device of claim 33, wherein the controller (16) is adapted to turn off the active occlusion control unit (6) when the presence of own-voice is not detected.

* * * * *